US005645724A

United States Patent [19]

Lamort

[11] Patent Number: 5,645,724

[45] Date of Patent: Jul. 8, 1997

[54] ROTOR-EQUIPPED CYLINDRICAL SCREENS

[75] Inventor: Jean Pierre Lamort, St. Amand Sur Fion, France

[73] Assignee: E & M Lamort, Vitry le Francois, France

[21] Appl. No.: 513,043

[22] Filed: Aug. 9, 1995

[30] Foreign Application Priority Data

Aug. 10, 1994 [FR] France ..... 94 09886

[51] Int. Cl.[6] ..... B07B 1/20; B01D 29/64; B01D 29/62

[52] U.S. Cl. ..... 210/415; 209/250; 209/273; 209/360

[58] Field of Search ..... 210/415, 414, 210/413; 162/55, 261; 209/250, 273, 360

[56] References Cited

U.S. PATENT DOCUMENTS 2,835,173 5/1958 Martindale .
4,776,951 10/1988 Rowland .
5,061,370 10/1991 Ferland .
5,071,543 12/1991 Rajala .
5,156,750 10/1992 Henricson .
5,176,261 1/1993 Holz .
5,192,438 3/1993 Freiborg .
5,492,225 2/1996 Musselmann .

FOREIGN PATENT DOCUMENTS 63-135587 6/1988 Japan .

*Primary Examiner*—Thomas M. Lithgow
*Attorney, Agent, or Firm*—Lowe, Price, Leblanc & Becker

[57] ABSTRACT

A cylindrical screen within which rotates a rotor fitted with means causing pressure variations and/or turbulence. The rotor (1) consists of one or several cylindrical surface segments (2) which when geometrically developed are right triangles of which the two perpendicular sides (3, 4) resp. correspond to the cylinder base (3) and to the height (4) and of which the oblique side (5) constitutes the hypothenuse.

6 Claims, 2 Drawing Sheets

ROTOR-EQUIPPED CYLINDRICAL SCREENS

The present invention relates to cylindrical screens equipped with an internal rotor and more specifically to screens used in the paper-pulp industry.

It is known in the paper-pulp industry and in particular in the old-paper recycling sector to use cylindrical screens which are operated either centrifugally, with the product being filtered flowing from the inside to the outside, or centripetally, with the product flowing in the inverted direction, that is from the outside to the inside. Such screens tend to clog because the fibers and especially the long fibers tend to place themselves hard across the screen orifices. It is known to remedy this situation by inducing pressure variations or turbulence upstream or downstream of the screen to detach the fibers across the orifices.

In order to induce these pressure variations or turbulence, it is known to mount a cylindrical rotor inside the screen, said rotor being fitted with means inducing pressure variations and/or turbulence.

Such means may be fins, often called foils, or projections/bosses from the surface of a cylinder or thickness increases at the cylinder surfaces.

The present invention concerns such species of rotors but it differs entirely from the known rotors in that its rotor no longer is a cylinder but instead is composed of one or several cylindrical surface segments which when geometrically developed onto a plane are right triangles of which the two perpendicular sides correspond resp. to a generatrix and to the cylinder base and of which the hypothenuse is oblique.

These triangle-cylinder surfaces may comprise bosses/projections, which, if called for, are profiled, at their oblique side.

Figure 1A:
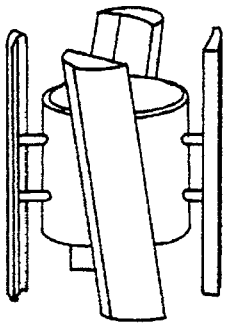
FIG. 1a PRIOR ART
Figure 1B:
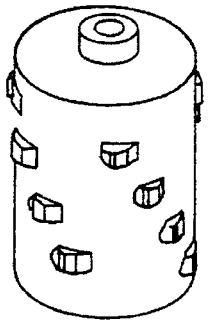
FIG. 1b PRIOR ART
Figure 1C:
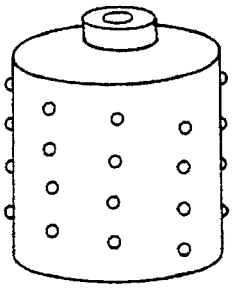
FIG. 1c PRIOR ART
Figure 1D:
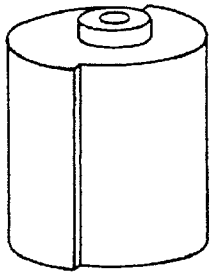
FIG. 1d PRIOR ART
Figure 2:
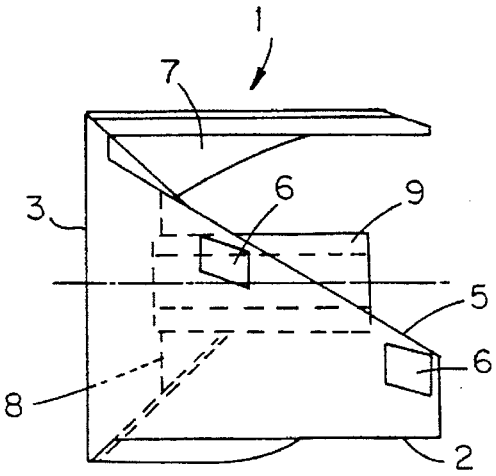
Figure 3:
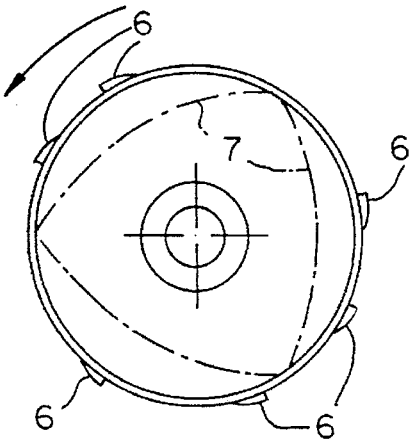
Figure 4:
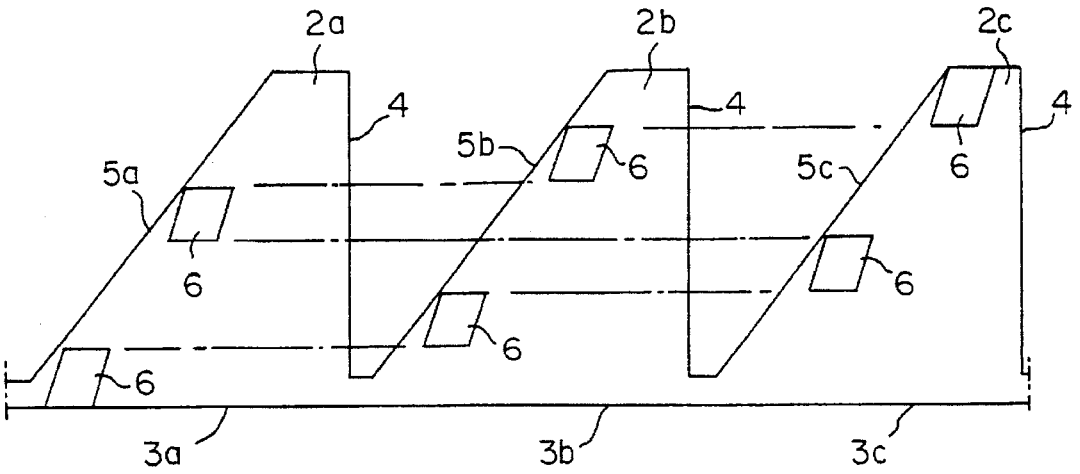
Figure 5:
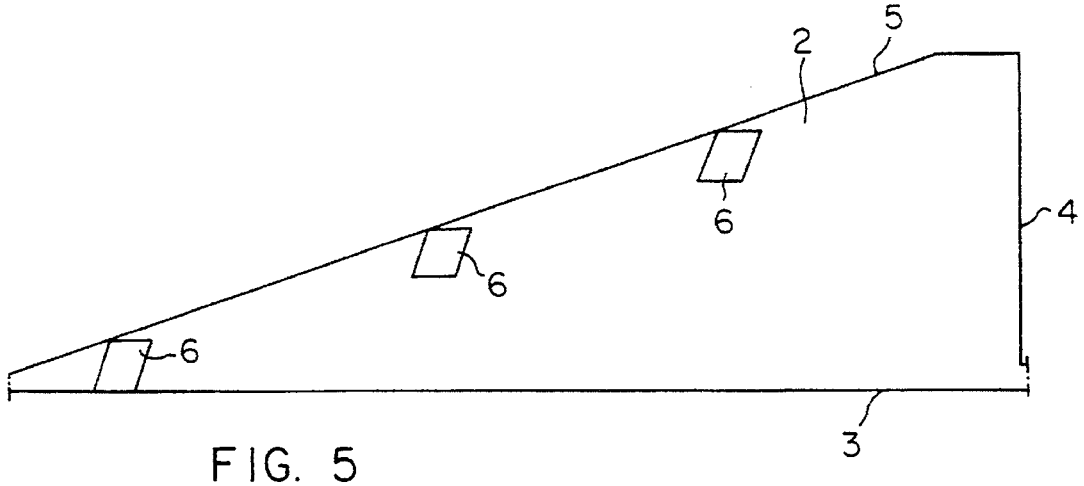
Figure 6:
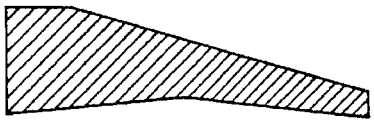

Illustratively and without thereby implying limitation, and to elucidate the invention, the attached drawings show the following:

FIGS. 1*a*–1*d* (FIG. 1) shows four models 1*a* through 1*d* of known devices, FIG. 2 is a side view of a rotor embodiment of the invention, FIG. 3 is a view along arrow F of FIG. 2, FIG. 4 is a geometrically developed view of the rotor of FIG. 2, FIG. 5 is a geometrically developed view of an embodiment variation, and FIG. 6 is a cross-section of an illustrative projection.

FIG. 1 shows four models of known rotors (1*a*, 1*b*, 1*c*, 1*d*). FIG. 1*a* shows a cylindrical rotor with four fins which, when moving past the inner screen surface (omitted), generate a slight excess pressure at the fore and a slight depression at the rear. A slight pressure pulsation results, which detaches the fibers held across the screen orifices (holes or slots) in both centrifugal and centripetal screen operating modes. FIGS. 1*b* and 1*c* show a cylindrical rotor of which the surface comprises bosses/projections producing turbulence and slight pressure variations. FIG. 1*d* shows a rotor composed of two offset half-cylinders producing an abrupt rise in pressure followed by a gradual decrease.

The rotor shown in FIGS. 2 through 4 evinces an entirely different design.

These Figures show that the rotor 1 is not constituted by a regular cylindrical surface of which the geometric development would be a rectangle but instead consists of a cylindrical portion 2. In the embodiment shown, there are three cylindrical surface segments 2*a*, 2*b*, 2*c* though only one or more than three also are conceivable. FIG. 5 is a geometric development of a rotor comprising only one cylindrical surface segment.

In FIGS. 4 and 5, each cylindrical surface segment ("2" in FIG. 5, "2*a*, 2*b*, 2*c*" in FIG. 4) geometrically develops a right triangle of which the base 3 corresponds to the cylinder base and of which the side 4 corresponds to the height or to a cylinder generatrix. The sides 3 and 4 are perpendicular and the oblique side 5 constitutes the hypothenuse of the right triangle.

When winding up the geometrically developed surface shown in FIG. 4, the rotor shown in FIGS. 2 and 3 ensues, and it may be said that its surface is a cylinder-triangle.

For simplicity, hereafter each portion of cylinder-triangle surface shall be called "lobe". Accordingly the rotor shown in FIGS. 2 through 4 comprises three lobes, whereas that of FIG. 5 is a single lobe.

The invention is not restricted to the shown embodiment modes. There must be at least one lobe, however there may two, three, four or more.

On account of this very special rotor geometry, the inner screen wall during rotor rotation will alternatingly be opposite a surface wall and opposite none. As a result the residues are permanently recycled and the sifting will be much more efficient. Moreover, the fibers that might agglomerate on the ridge 5 will slide along it.

As shown by FIGS. 2 through 5, bosses/projections similar to those shown in FIG. 1*b* may be mounted on the lobe walls.

In the present invention, these bosses/projections 6 are arrayed along the oblique side 5 of each lobe 2.

In the case of several lobes, as shown in FIG. 4, the bosses/projections are mutually offset.

Preferably these bosses/projections evince the shape shown in FIG. 6, that is, their cross-section progressively decreases from their fore surface (relative to the rotor direction of rotation) toward their rear surface.

Preferably again, the lobes are cut from sheetmetal and are reinforced inside each lobe by a reinforcement means 7 consisting of a curved sheetmetal piece joined at its base to a disk 8 itself rigidly joined to a bush 9 mounted onto an omitted drive shaft.

I claim:

1. Cylindrical screen within which rotates a rotor fitted with means generating pressure variations and/or turbulence, wherein said rotor (1) consists of one or more cylindrical surface segments (2) which when geometrically developed are right triangles of which the two perpendicular sides (3, 4) respectively corresponding to the cylinder base made of one or more of the first one of said tow perpendicular sides (3) and to the height of the cylindrical triangle made of the height of the second one of said two perpendicular sides (4) and of which the oblique side (5) of each cylindrical triangle constitutes the hypothenuse.

2. Screen defined in claim 1, characterized in that each cylinder-triangle surface comprises a plurality of bosses/projections (6).

3. Screen defined in claim 2, wherein the bosses/projections (6) are arrayed along the oblique side (5).

4. Screen defined in claim 3, wherein, said rotor consists of several cylindrical triangles, the bosses/projections (6) between each cylindrical triangle are mutually offset.

5. Screen defined in claim 2, wherein the cross-section of each boss/projection (6) decreases from its fore to its rear.

6. Screen defined in claim 1, wherein each cylindrical triangle is cut out of sheetmetal and is reinforced by a web (7) resting on a disk (8) rigidly joined to a bush (9).

* * * * *